US007533975B2

(12) United States Patent
Koga et al.

(10) Patent No.: US 7,533,975 B2
(45) Date of Patent: May 19, 2009

(54) INK-JET RECORDING APPARATUS

(75) Inventors: Yuji Koga, Nagoya (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 266 days.

(21) Appl. No.: 11/276,448

(22) Filed: Feb. 28, 2006

(65) Prior Publication Data

US 2006/0192821 A1 Aug. 31, 2006

(30) Foreign Application Priority Data

Feb. 28, 2005 (JP) ..... 2005-053068

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS 5,671,001 A * 9/1997 Elliot et al. ..... 347/87
5,734,390 A * 3/1998 Sakaizawa et al. ..... 347/2
6,302,530 B1 10/2001 Shimada et al.
6,629,758 B2 10/2003 Okamoto et al.

FOREIGN PATENT DOCUMENTS

JP 8001956 1/1996
JP 10235890 9/1998
JP 2001301197 A1 10/2001

* cited by examiner

*Primary Examiner*—Anh T. N. Vo
(74) *Attorney, Agent, or Firm*—Baker Botts L.L.P.

(57) ABSTRACT

An ink-jet recording apparatus is provided in which mixing of different colors of ink in ink supply openings is inhibited. A recording head has a plurality of sub-tanks, each of which stores a different color of ink. The recording head records an image onto a recording medium by selectively ejecting a different color of ink in each of the sub-tanks from ejection nozzles. Main tanks store ink to refill the corresponding sub-tanks, and an ink supply member supplies the ink in the main tanks to the sub-tanks. An ink supply opening for receiving ink to be supplied is provided in each sub-tank. The ink supply member supplies the ink in the main tank to the ink supply opening. The supply openings are arranged to form a zigzag. Accordingly, reduction in size of the recording head can be achieved.

11 Claims, 9 Drawing Sheets

INK-JET RECORDING APPARATUS

CROSS-REFERENCE TO RELATED APPLICATIONS

This application claims the benefit of Japanese Patent Application No. 2005-53068 filed Feb. 28, 2005 in the Japan Patent Office, the disclosure of which is incorporated herein by reference.

BACKGROUND

This invention relates to an ink-jet recording apparatus that records an image on a recording medium by ejecting ink from a recording head.

Conventional ink-jet recording apparatus are known to include a sub-tank provided in a recording head that stores ink to be ejected onto a recording medium, and a main tank which stores ink to refill the sub-tank. Among the ink-jet recording apparatus having such an ink supply system, there is an apparatus which connects the main tank to the sub-tank only when an ink supply to the sub-tank is necessary (i.e., an apparatus having a so-called stationary supply system). The ink-jet recording apparatus having the stationary supply system includes in the sub-tank with an ink supply opening for receiving the ink to be supplied. A supply nozzle for supplying the ink in the main tank is inserted to the ink supply opening so that the ink can be supplied from the main tank to the sub-tank. In order to allow such an ink supply system, a resilient member (such as rubber) that prevents ink leakage is used in the ink supply opening.

On the other hand, the recent mainstream ink-jet recording apparatus perform color recording. An image is recorded by a plurality of colors (such as CMYK) of ink ejected from a recording head. In such ink-jet recording apparatus, the recording head includes a plurality of sub-tanks that store different colors of ink. Each sub-tank is provided with the aforementioned ink supply opening. In these ink-jet recording apparatus, a plurality of ink supply openings as a whole are arranged in line on the same level.

SUMMARY

However, in the aforementioned in-line arrangement of the ink supply openings, a distance between each of the ink supply openings must be narrowed in order to reduce the size of the recording head. However, owing to the installation space for the resilient member used in the ink supply openings, the distance between the openings cannot be sufficiently narrowed. Accordingly, there is a problem that the recording head cannot be sufficiently reduce in size. The distance between the ink supply openings can be narrowed to some extent by miniaturizing the resilient member. However, such a miniaturized resilient member may deteriorate adhesion (sealing property). Thus, there are limitations in the above method for narrowing the interval between the ink supply openings.

On the other hand, due to the repeated operation of connecting and disconnecting the supply nozzle to and from the ink supply opening, there is a fear that ink leakage may occur. In a constitution in that the ink supply openings are provided on the same level, there is a problem that a different color or colors of ink (that is the ink leaked from the adjacent ink supply opening(s)) may enter the ink supply opening for another color of ink, which causes mixing of different colors of ink.

The present invention is made to solve the above problems. It would be desirable to reduce the size of a recording head. It would be further desirable if mixing of different colors of ink in ink supply openings is inhibited.

It is desirable that an ink-jet recording apparatus of the present invention includes a recording head that has a plurality of sub-tanks, each of which stores a different color of ink. The recording head records an image onto a recording medium (at medium on which an image can be recorded with ink, e.g., a sheet or a sheet-like medium) by selectively ejecting different colors of ink in the sub-tanks from ejection nozzles. The ink-jet recording apparatus further includes main tanks that store ink to refill the corresponding sub-tanks, and an ink supply member that supplies the ink in the main tanks to the corresponding sub-tanks. Each of the sub-tanks is provided with an ink supply opening for receiving the ink to be supplied. The ink supply member supplies the ink in the main tanks to the ink supply openings provided in the sub-tanks. The ink supply openings are arranged to form a zigzag (i.e., not aligned but arranged alternately).

Each of the ink supply openings may be provided on a surface at a different level than the surface(s) where the adjacent ink supply opening(s) are provided.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

First Embodiment

Figure 1:
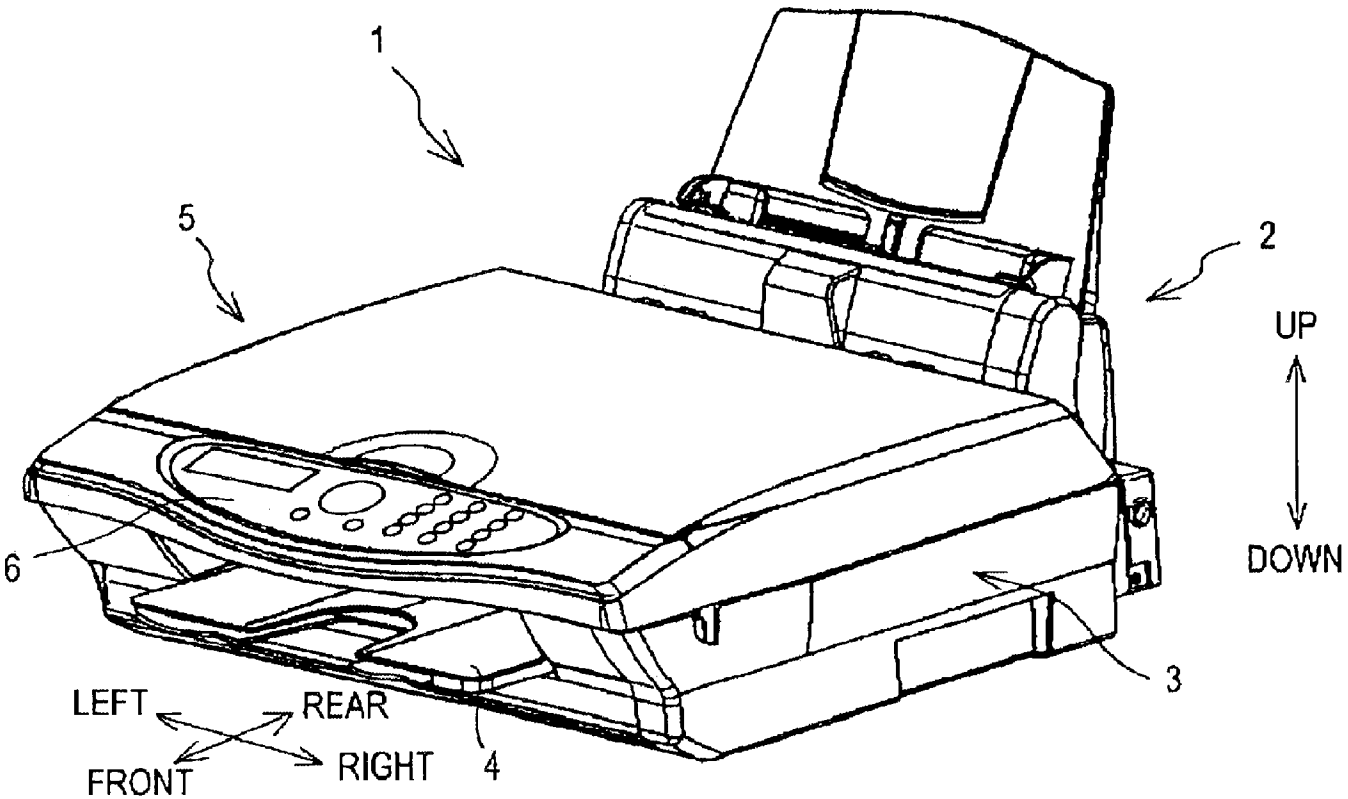
FIG. 1 is a perspective view of a multifunctional apparatus according to an embodiment of the present invention.

A multifunctional apparatus 1 shown in FIG. 1 is, the apparatus at a normal use state (referred to as a "standard"). In the following description, the terms pointing the directions such as "up (top)" and "down (below)" are based on this standard. The side on which a later-explained operation panel 6 is provided is indicated as "front", and the opposite side (the side on which a later-explained feeding device 2 is provided) is indicated as "rear (behind)". Moreover, the terms representing the directions like "right" and "left" are based on the state when the multifunctional apparatus 1 is viewed from the front (the side on which the operation panel 6 is provided).

The multifunctional apparatus 1 includes a printer function, a scanner function, a copying function, a facsimile function, a telephone (audio transmission) function, etc. The feeding device 2, on which a plurality of sheets can be loaded, is provided at the rear end part of the multifunctional apparatus 1. In the present embodiment, sheets are used as recording media. It should be noted that resin films such as for OHPs (overhead projectors) can be used as well. An ink-jet printer 3 is provided on the front side below the feeding device 2. A discharge tray 4 is provided on the front side of the printer 3. On top of the printer 3, a reader 5 is provided for the copying function and facsimile function. The operation panel 6 is provided on the upper face at the front end of the reader 5.

Figure 2:
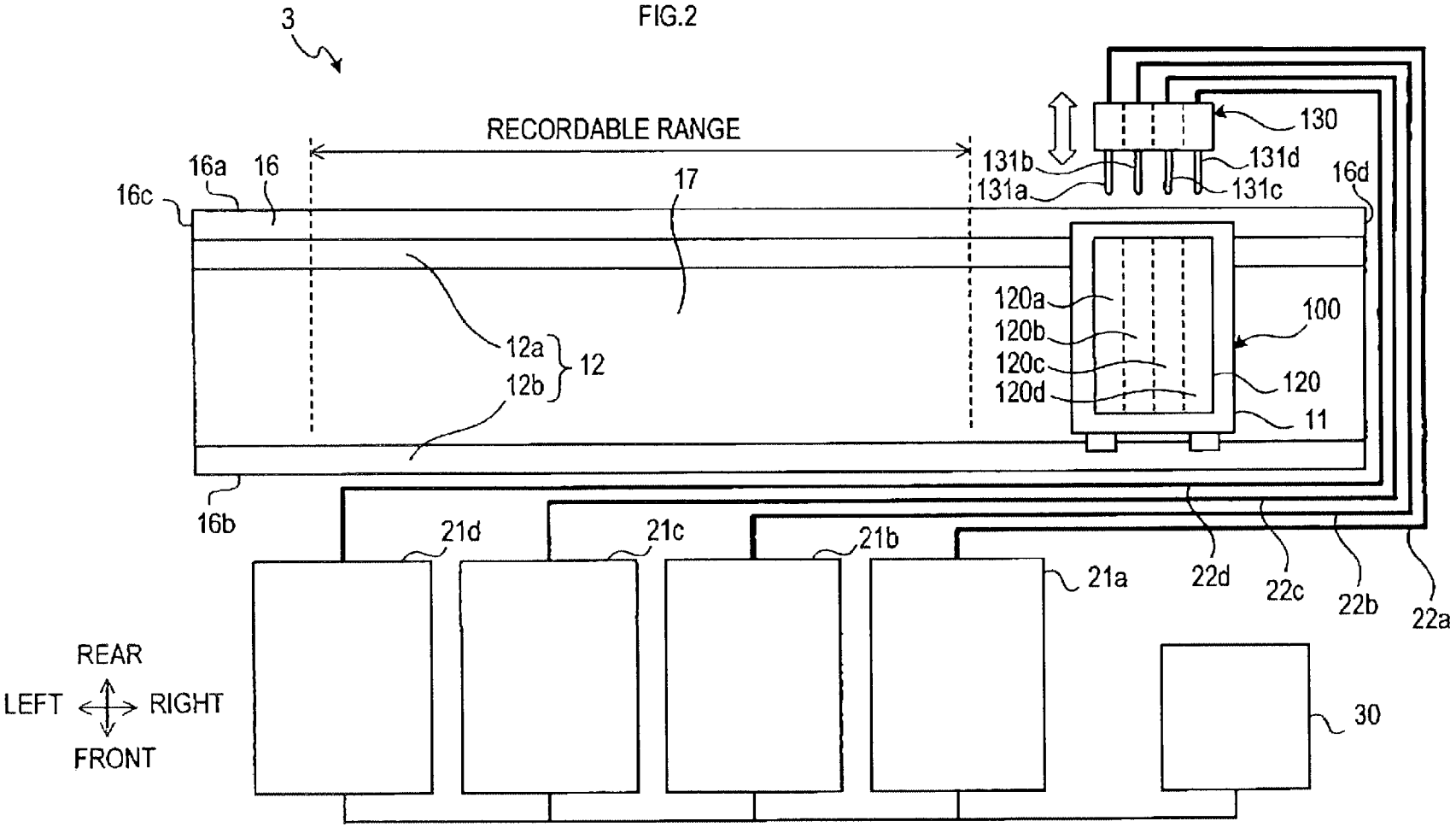
FIG. 2 is a schematic top view showing an internal structure of a printer provided in a multifunctional apparatus according to a first embodiment.

Now, the structure of the printer 3 is described by way of FIG. 2. FIG. 2 is a schematic diagram showing the internal structure of the printer 3 viewed from above.

As shown in FIG. 2, the printer 3 includes a recording head 100, a carriage 11, a guide mechanism 12, a carriage moving mechanism (not shown), a sheet delivery mechanism (not shown), etc. The guide mechanism 12 holds the carriage 11 which mounts the recording head 100 thereon in such a manner that the carriage 11 can move in a horizontal (right and left) direction or a main scanning direction. The carriage moving mechanism moves the carriage 11 in the horizontal direction. The sheet delivery mechanism delivers a sheet fed from the feeding device 2.

The printer 3 is also provided with a frame 16 of a rectangular parallelepiped. The frame 16 is long in the horizontal direction and short in a vertical (up and down) direction. The aforementioned guide mechanism 12, the carriage moving mechanism, the sheet delivery mechanism, etc. are all attached to the frame 16. Moreover, the recording head 100 and the carriage 11 are accommodated inside the frame 16 in such a manner that the recording head 100 and the carriage 11 can move in the horizontal direction.

An inlet and an outlet (neither shown) for feeding and discharging a sheet are respectively formed on a rear end board 16*a* and a front side board 16*b* of the frame 16. The sheet fed by the feeding device 2 is guided into the frame 16 through the inlet. The sheet is then delivered forward by the sheet delivery mechanism and discharged through the outlet to the discharge tray 5 (see FIG. 1) located further downstream. Also, a black platen 17, having a plurality of ribs, is attached to the bottom portion of the frame 16. Inside the frame 16, recording (image forming) by the recording head 100 is performed on the sheet being moved intermittently across the platen 17.

The guide mechanism 12 has a guide shaft 12*a* and a guide rail 12*b*. The guide shaft 12*a* is laid along the horizontal direction at the rear portion inside the frame 16. Both ends of the guide shaft 12*a* are respectively connected to a left side board 16*c* and a right side board 16*d* of the frame 16. The guide rail 12*b* is formed at the front portion inside the frame 16 and extends along the horizontal direction. The rear end portion of the carriage 11 slidably fits onto the guide shaft 12*a*, while the front end portion of the carriage 11 slidably engages the guide rail 12*b*.

The carriage moving mechanism is constituted from a carriage motor and a belt mechanism (neither shown). The belt mechanism transmits a driving force of the carriage motor to the carriage 11. The carriage 11 moves in the horizontal direction by the drive of the carriage motor.

The sheet delivery mechanism is provided with a sheet delivery motor, a resist roller, a discharge roller, and a belt mechanism (none shown). The belt mechanism transmits a driving force of the sheet delivery motor to the resist roller and the discharge roller. The sheet is delivered toward downstream by the drive of the sheet delivery motor.

Four main tanks (ink cartridges) 21*a* to 21*d* which respectively store a different color of ink are attached to a cartridge attachment portion provided on the front side of the frame 16. The four colors of ink is to be supplied to later-explained sub-tanks 120*a* to 120*d*. Particularly, magenta color ink is stored in the main tank 21*a*, yellow in the main tank 21*b*, black in the main tank 21*c*, and cyan in the main tank 21*d*.

The main tanks 21*a* to 21*d* are connected via four flexible ink tubes 22*a* to 22*d* to an ink supply mechanism 130 which is disposed in the vicinity of the right end of the frame 16. In particular, one end of the ink tube 22*a* is connected to the main tank 21*a*, and the other end of the ink tube 22*a* is connected to the supply mechanism 130, so that the ink tube 22*a* serves as an ink supply passage for supplying magenta color ink in the main tank 21*a* to the ink supply mechanism 130. Likewise, one end of the ink tube 22*b* is connected to the main tank 21*b*, and the other end of the ink tube 22*b* is connected to the supply mechanism 130, so that the ink tube 22*b* serves as an ink supply passage for supplying yellow color ink in the main tank 21*b* to the ink supply mechanism 130. Likewise, one end of the ink tube 22*c* is connected to the main tank 21*c*, and the other end of the ink tube 22*c* is connected to the supply mechanism 130, so that the ink tube 22*c* serves as an ink supply passage for supplying black color ink in the main tank 21*c* to the ink supply mechanism 130. Likewise, one end of the ink tube 22*d* is connected to the main tank 21*d*, and the other end of the ink tube 22*d* is connected to the supply mechanism 130, so that the ink tube 22*d* serves as an ink supply passage for supplying cyan color ink in the main tank 21*d* to the ink supply mechanism 130.

Figure 3B:
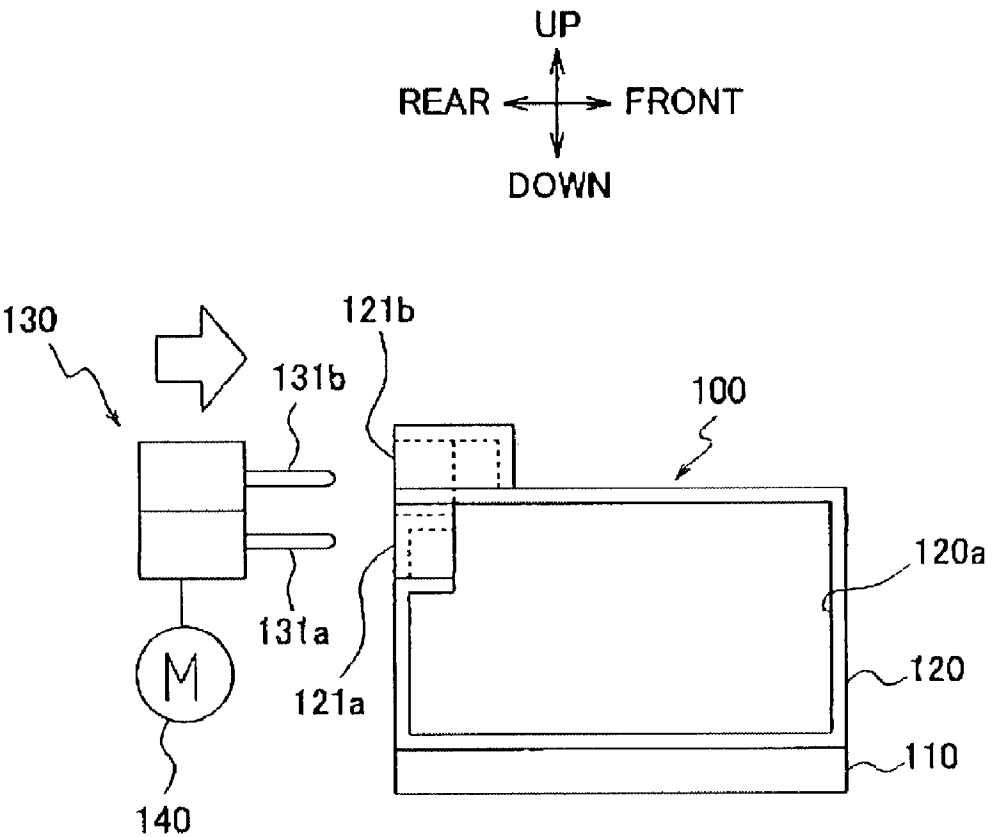
FIGS. 3A and 3B are explanatory views of a recording head and an ink supply mechanism according to the first embodiment.

The ink supply mechanism 130 is provided to face the rear surface (surface on which later-explained ink supply openings 122*a* to 122*d* are provided) of the recording head 100 (particularly, a later-explained ink reservoir 120), when the carriage 11 is located at a predetermined ink refill position (shown in FIG. 2) outside (in particular, at the right side of) the range (recordable range) where image recording by the recording head 100 can be performed. The ink supply mechanism 130 is constituted such that the ink supply mechanism 130 can reciprocate forward and rearward (toward/away from the rear surface of the recording head 100) by a driving force of an ink supply mechanism driving motor 140 (see FIG. 3B). The ink supply mechanism 130 includes four tubular supply nozzles 131*a* to 131*d* for supplying ink stored in the main tanks 21*a* to 21*d* to the recording head 100 (the later-explained ink reservoir 120, in particular). More precisely, the supply nozzle 131*a* is constituted to eject, from the tip, magenta color ink supplied from the main tank 21*a* via the ink tube 22*a*. Likewise, the supply nozzle 131*b* is constituted to eject, from the tip, yellow color ink supplied from the main tank 21*b* via the ink tube 22*b*, the supply nozzle 131*c* is constituted to eject, from the tip, black color ink supplied from the main tank 21*c* via the ink tube 22*c*, and the supply nozzle 131*d* is constituted to eject, from the tip, cyan color ink supplied from the main tank 21*d* via the ink tube 22*d*. The ink stored in the main tanks 21*a* to 21*d* is supplied to the ink supply mechanism 130 by a pressure from a pump 30.

Figure 3A:
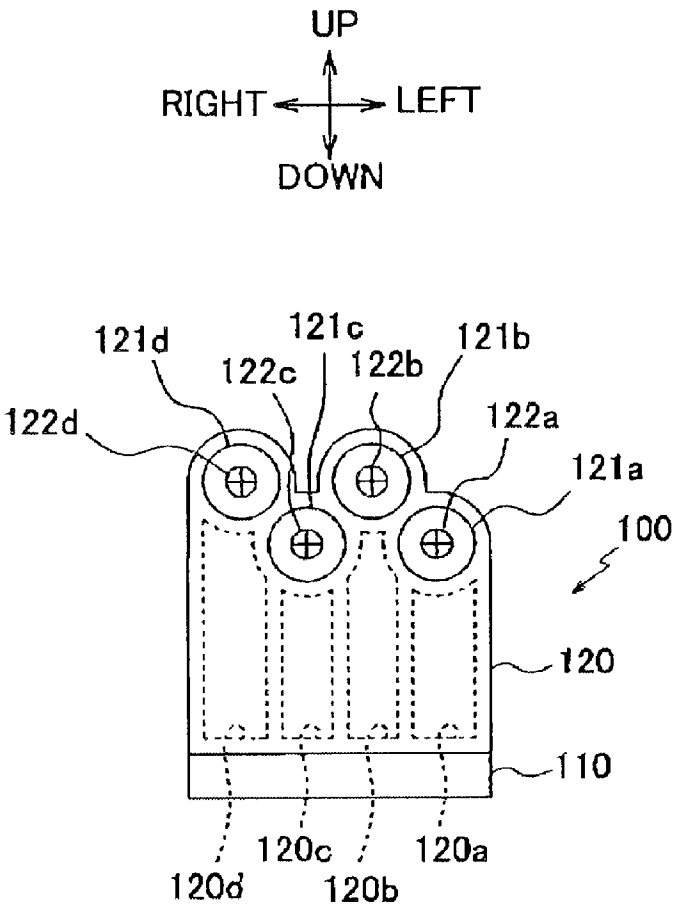

As shown in FIG. 3A, the recording head 100 includes an ink ejector 110 that ejects ink onto a sheet, and the ink reservoir 120 that is provided on the top of the ink ejector 110 and stores ink ejected from the ink ejector 110.

The ink ejector 110 includes four ejection nozzle groups (not shown) provided on the undersurface. Each of the ejection nozzle groups is composed of a plurality of ejection nozzles arranged in line along a sheet delivery direction (back and forth direction). Each of the ejection nozzle groups corresponds to one of four colors (black, cyan, yellow, and magenta) of ink. The ejection nozzle groups are arranged in parallel in a moving direction (horizontal direction) of the carriage 11.

The ink reservoir 120 includes the internal sub-tanks 120*a* to 120*d*, each of which stores one of the four colors of ink. The recording head 100 is constituted such that the different colors of ink stored in the sub-tanks 120*a* to 120*d* is supplied to the corresponding ejection nozzle groups of the ink ejector 110. Image recording onto a sheet is performed by selectively ejecting ink in the sub-tanks 120*a* to 120*d* from the ejection nozzle groups of the ink ejector 110, based on the image data representing an image to be recorded.

On the side surface (rear surface) of The ink reservoir 120, ink supply openings 122*a* to 122*d* are provided through which ink to be supplied (for a refill) from the main tanks 21*a* to 21*d* is received. Particularly, a round opening is formed at the upper part of the side wall (the side wall of the rear surface) of the respective sub-tanks 120*a* to 120*d*, and elastic members (cylindrical rubber members, in the present embodiment) 121*a* to 121*d* ware applied to close the corresponding openings A cross-shaped cut which communicates the inside and outside of the ink reservoir 120 is provided at the center part of the respective elastic members 121*a* to 121*d*. These cuts form the ink supply openings 122*a* to 122*d*, to which the supply nozzles 131*a* to 131*d* of the ink supply mechanism 130 are inserted. This constitution renders possible to seal the ink supply openings 122*a* to 122*d* due to resilience of the elastic members 121*a* to 121*d*, when the supply nozzles 131*a* to 131*d* are not inserted to the ink supply openings 122*a* to 122*d*.

Part on the upper surface of the ink reservoir 120, corresponding to the positions of the elastic members 121*b* and 121*d*, projects upward so that the elastic members 121.*b* and 121*d* are disposed at a higher position than the elastic members 121*a* and 121*c*. Accordingly, the ink supply openings 122*b* and 122*d* are disposed higher than the ink supply openings 122*a* and 122*c* in such a way that, when viewed from behind, the ink supply openings 122*a* to 122*d* as a whole are arranged to form a zigzag (FIG. 3A). In the present embodiment, the ink supply openings 122*a* and 122*c* are arranged at the same level, and the ink supply openings 122*b* and 122*d* are arranged at the same level.

The supply nozzles 131*a* to 131*d* of the ink supply mechanism 130 are arranged to form a zigzag, and face the corresponding ink supply openings 122*a* to 122*d* provided on the rear surface of the ink reservoir 120, so that the supply nozzles 131*a* to 131*d* are inserted to the corresponding ink supply openings 122*a* to 122*d* by moving the ink supply mechanism 130 toward the ink reservoir 120 (forward), when the carriage 11 is at the predetermined ink refill position (the position shown in FIG. 2). More particularly, the supply nozzle 131*a* is inserted to the ink supply opening 122*a* as the ink supply mechanism 130 approaches the ink reservoir 120, and supplies magenta color ink to the sub-tank 120*a* from the main tank 21*a* via the ink tube 22*a*. The supply nozzle 131*b* is inserted to the ink supply opening 122*b* as the ink supply mechanism 130 approaches the ink reservoir 120, and supplies yellow color ink to the sub-tank 120*b* from the main tank 21*b* via the ink tube 22*b*. The supply nozzle 131*c* is inserted to the ink supply opening 122*c* as the ink supply mechanism 130 approaches the ink reservoir 120, and supplies black color ink to the sub-tank 120*c* from the main tank 21*c* via the ink tube 22*c*. The supply nozzle 131*d* is inserted to the ink supply opening 122*d* as the ink supply mechanism 130 approaches the ink reservoir 120, and supplies yellow color ink to the sub-tank 120*d* from the main tank 214 via the ink tube 22*b*.

As noted above, the multifunctional apparatus 1 of the first embodiment is constituted such that each of the sub-tanks 120*a* to 120*d* of the recording head 100 is refilled with one of four colors of ink from the main tanks 21*a* to 21*d*. The ink supply openings 122*a* to 122*d* are arranged to form a zigzag (FIG. 3A).

Therefore, according to the multifunctional apparatus 1 of the first embodiment, the ink reservoir 120 (recording head 100) can be miniaturized, and thus the multifunctional apparatus 1 can be reduced in size.

That is, if the ink supply openings 122*a* to 122*d* are arranged on the same straight line (in line), miniaturization (in particular, a narrowing of width in the horizontal direction) of the ink reservoir 120 is limited by the length of the line of the ink supply openings 122*a* to 122*d*, since the ink reservoir 120 must be designed as large as that the line of the ink supply openings 122*a* to 122*d* can be fitted therein. Accordingly, it is necessary to narrow the distance between the ink supply openings 122*a* and 122*d* as much as possible. However, in order to secure the installation space for the elastic members 121*a* to 121*d*, it is also necessary to maintain the distance between the ink supply openings 122*a* and 122*d* to a certain extent. Therefore, if the ink supply openings 122*a* to 122*d* are arranged on the same straight line, sufficient miniaturization cannot be achieved.

To the contrary, in the multifunctional apparatus 1 of the first embodiment, since the ink supply openings 122*a* to 122*d* are arranged to form a zigzag, it is possible to narrow the distance between the ink supply openings 122*a* and 122*d* located at both ends, as compared to the case of arranging the ink supply openings 122*a* to 122*d* on the same straight line. Therefore, miniaturization of the ink reservoir 120 can be achieved.

In the multifunctional apparatus 1 of the first embodiment, due to the zigzagged arrangement of the ink supply openings 122*a* to 122*d* on the side surfaces of the corresponding sub-tanks 120*a* to 120*d*, the levels at which each of the ink supply openings 122*a* to 122*d* is arranged are not uniform. The darkest color (black) ink and the second darkest color (magenta) ink among the four colors of ink are respectively supplied to the ink supply openings 122*c* and 122*a* which are arranged at the lower position.

Consequently, according to the multifunctional apparatus 1 of the first embodiment, even if a different color or colors of ink are undesirably introduced to the supply openings 122*a* to 122*d*, it is possible to minimize the influence.

That is, the ink leaking out from each of the ink supply openings 122*a* to 122*d* runs downward by gravity. Since the ink supply openings 122*a* and 122*c* are arranged at the lower position than the ink supply openings 122*b* and 122*d*, the probability that the ink from the ink supply openings 122*b* and 122*d* enters the ink supply openings 122*a* and 122*c* is lower than the probability that the ink from the ink supply openings 122*a* and 122*c* enters the ink supply openings 122*b* and 122*d*. Therefore, the dark colors of ink, which are less influenced even if a different color or colors of ink are introduced and which have a significant influence if introduced to the ink supply openings for different colors of ink, is supplied to the ink supply openings 122*a* and 122*c* arranged at the lower position. Accordingly, even in the case of mixing of different colors of ink, it is possible to reduce the influence.

Second Embodiment

Figures 4A, 4B, 4C:
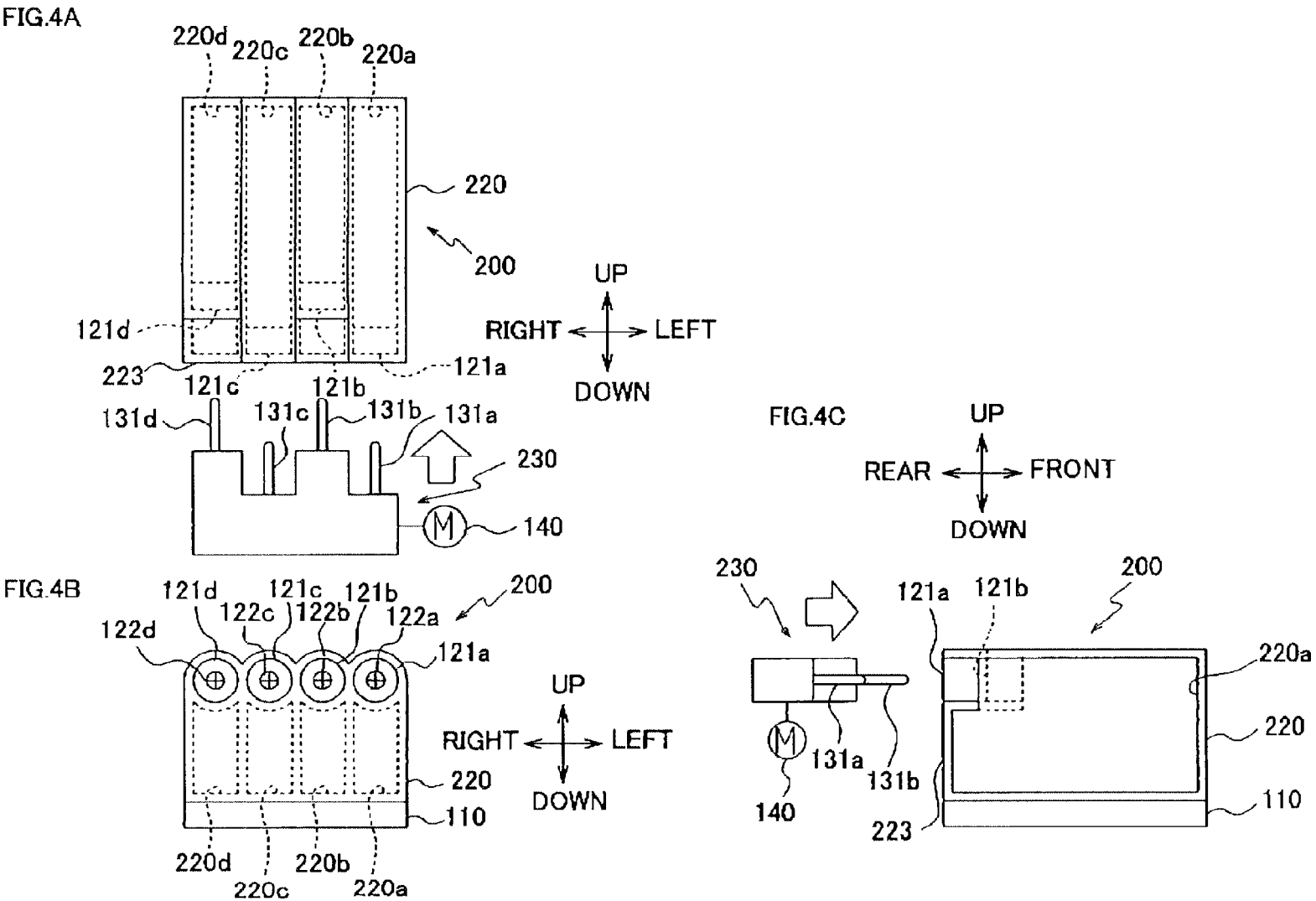
FIGS. 4A to 4C are explanatory views of a recording head and an ink supply mechanism according to a second embodiment.

The multifunctional; apparatus 1 according to the second embodiment is explained hereinafter. The appearance (FIG. 1) of the multifunctional apparatus 1 according to the second embodiment is identical to the appearance of the multifunctional apparatus 1 according to the first embodiment. However, the internal structure (FIG. 2) of the printer 3 is partly different. Particularly, as shown in FIGS. 4A and 4B, in an ink reservoir 220 of a recording head 200 provided in the multifunctional apparatus 1 of the second embodiment, the ink supply openings 122*a* to 122*d* are linearly arranged and not arranged to form a zigzag when viewed from behind (FIG. 4B). Moreover, each of the ink supply openings 122*a* to 122*d* is provided on a surface at a different level than the surface(s) where the adjacent ink supply opening(s) are provided (FIG. 4A). Accordingly, in an ink supply mechanism 230 provided in the multifunctional apparatus 1 of the second embodiment, the supply nozzles 131*a* to 131*d* are arranged linearly and not arranged to form a zigzag when viewed from the front. Moreover, positions of the front ends of the supply nozzles 131*a* to 131*d* ire different from the position(s) of the front end(s) of the adjacent supply nozzle(s) (FIG. 4A). That is, the multifunctional apparatus 1 of the second embodiment is different from the multifunctional apparatus 1 of the first embodiment only in the arrangement of the ink supply openings 122*a* to 122*d* and the supply nozzles 131*a* to 131*d*. The same reference numbers are given to the components identical to the components of the multifunctional apparatus 1 of the first embodiment, and the descriptions thereof are not repeated.

Part at the upper portion of the side surface (rear surface) of ink reservoir 220 of the recording head 200, corresponding to the position of the elastic members 121*b* and 121*d*, is dented to the inner side (frontward). The elastic members 121*b* and 121*d* are provided farther from the rear end surface 223 of the ink reservoir 220 than the elastic members 121*a* and 121*c*. Thereby, the ink supply openings 122*b* and 122*d* are provided farther from the rear end surface 223 of the ink reservoir 220 than the ink supply openings 122*a* and 122*c*. Each of the supply openings 122*a* to 122*d* is provided on the surface at a different level from the surface(s) where the adjacent ink supply opening(s) are provided. In the present embodiment, the ink supply openings 122*a* and 122*c* are provided on the rear end surface 223 of the ink reservoir 220, and the ink supply openings 122*b* and 122*d* are provided the same distance away from the rear end surface 223 of the ink reservoir 220.

On the other hand, the supply nozzles 131*a* to 131*d* of the ink supply mechanism 230 are arranged to face the corresponding ink supply openings 122*a* to 122*d* in such a way that, when the carriage 11 is located at the predetermined ink refill position, the ink supply mechanisms 230 is moved toward the ink reservoir 220 (forward) and that the supply nozzles 131*a* to 131*d* are inserted to the corresponding ink supply openings 122*a* to 122*d*.

As noted above, the multifunctional apparatus 1 of the second embodiment is constituted such that each of the sub-tanks 220*a* to 220*d* of the recording head 200 is refilled with one of four colors of ink from the main tanks 21*a* to 21*d*. Each of the ink supply openings 122*a* to 122*d* that allow the supply of ink is provided on the surface at a different level than the surface(s) where the adjacent ink supply opening(s) are provided (FIG. 4A).

Therefore, according to the multifunctional apparatus 1 of the second embodiment, unintended entering of a different color or colors of ink to the ink supply openings 122*a* to 122*d* can be avoided.

That is, when the ink supply openings 122*a* to 122*d* are provided in the same plane, narrowing of the distance between the ink supply openings adjacent to each other may cause undesirable entering of a different color or colors of ink (the ink for the adjacent ink supply opening(s)) to the ink supply openings 122*a* to 122*d*.

To the contrary, in the multifunctional apparatus 1 of the second embodiment, each of the ink supply openings 122*a* to 122*d* is provided on the surface at a different level than the surface(s) where the adjacent ink supply opening(s) are provided. Therefore, mixing of different colors of ink is more difficult than the case in which all the ink supply openings 122*a* to 122*d* are provided in the same plane.

In the multifunctional apparatus 1 of the second embodiment, since each of the ink supply openings 122*a* to 122*d* is provided on the surface at a different level than the surface(s) where the adjacent ink supply opening(s) are provided, on the side surface of each of the sub-tanks 120*a* to 120*d*, distances between the rear end surface 223 of the ink reservoir 220 and each of the ink supply openings 122*a* to 122*d* are not uniform. The darkest color (black) ink and the second darkest color (magenta) ink among the four colors of ink are respectively supplied to the ink supply openings 122*c* and 122*a* which are provided on the rear end surface 223 of the ink reservoir 220.

Consequently, according to the multifunctional apparatus 1 of the second embodiment, even if a different color or colors of ink are undesirably introduced to the supply openings 122*a* to 122*d*, it is possible to minimize the influence.

That is, the ink leaking out from each of the ink supply openings 122*a* to 122*d* runs downward along the rear end surface 223 of the ink reservoir 220. In other words, the ink leaking from each of the ink supply openings 122*a* to 122*d* flows to the side of the rear end surface 223 of the ink reservoir 220. Since the ink supply openings 122*a* and 122*c* are provided farther from rear end surface 223 of the ink reservoir 220 than the ink supply openings 122*b* and 122*d*, the probability that the ink from the ink supply openings 122*b* and 122*d* enters the ink supply openings 122*a* and 122*c* is lower than the probability that the ink from the ink supply openings 122*a* and 122*c* enters the ink supply openings 122*b* and 122*d*. Therefore, the dark colors of ink, which are less influenced even if a different color or colors of ink are introduced and which have a significant influence if introduced to the ink supply openings for different colors of ink, is supplied to the ink supply openings 122*a* and 122*c* arranged on the rear end surface 223 of the ink reservoir 220. Accordingly, even in the case of mixing of different colors of ink, it is possible to reduce the influence.

Third Embodiment

Figure 5B:
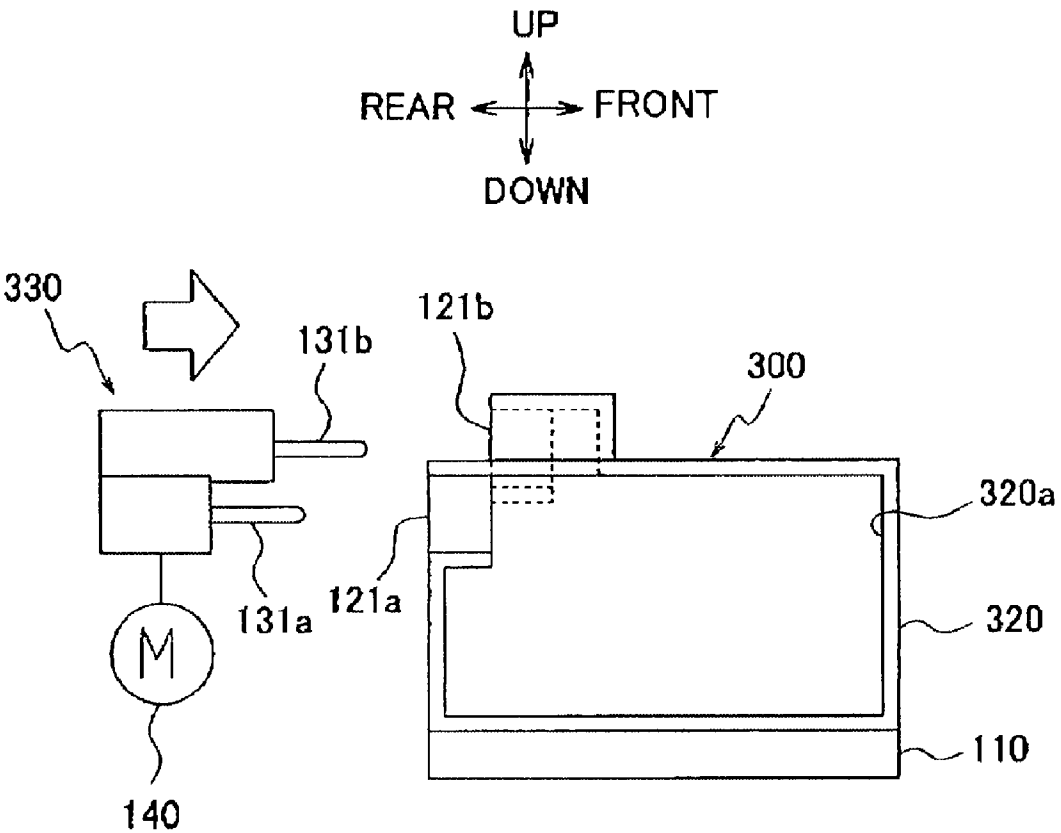
FIGS. 5A and 5B are explanatory views of a recording head and an ink supply mechanism according to a third embodiment.
Figure 5A:
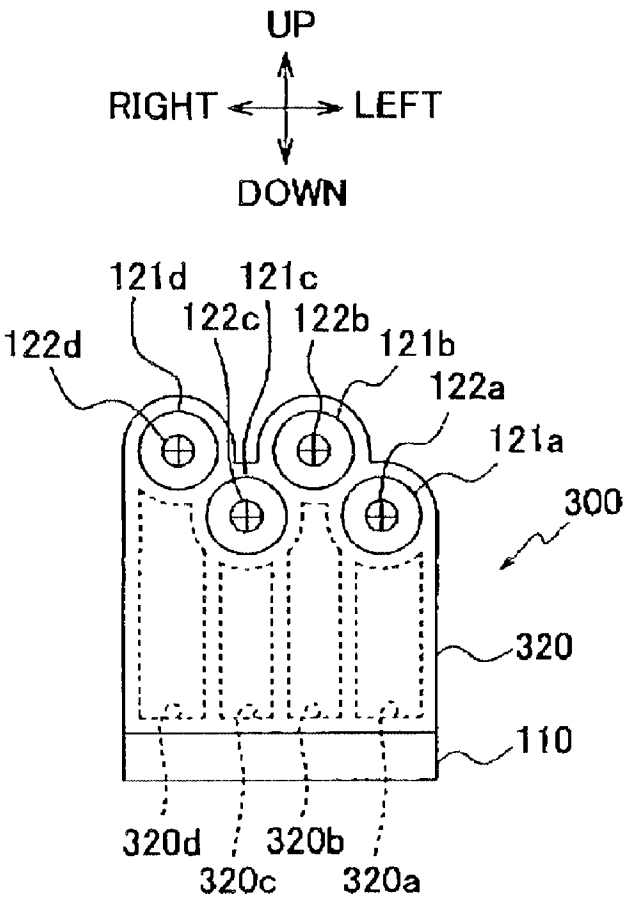

The multifunctional apparatus 1 according to the third embodiment is explained hereinafter. The appearance (FIG. 1) of the multifunctional apparatus 1 according to the third embodiment is identical to the appearance of the multifunctional apparatus 1 according to the first embodiment. However, the internal structure (FIG. 2) of the printer 3 is partly different. Particularly, as shown in FIGS. 5A and 5B, in an ink reservoir 320 of a recording head 300 provided in the multifunctional apparatus 1 of the third embodiment, the ink supply openings 122*a* to 122*d* are arranged to form a zigzag when viewed from behind (FIG. 5A), as in the first embodiment. However, each of the ink supply openings 122*a* to 122*d* is provided on a surface at a different level than the surface(s) where the adjacent ink supply opening(s) are provided, as in the second embodiment. Accordingly, in an ink supply mechanism 330 provided in the multifunctional apparatus 1 of the third embodiment, the supply nozzles 131*a* to 131*d* are arranged to form a zigzag when viewed from the front. However, positions of the front ends of the supply nozzles 131*a* to 131*d* are different from the positions of the front end(s) of the adjacent supply nozzle(s), as in the second embodiment. That is, the multifunctional apparatus 1 of the third embodiment is different from the multifunctional apparatus 1 of the first embodiment, only in the arrangement of the ink supply openings 122*a* to 122*d* and the supply nozzles 131*a* to 131*d*. The same reference numbers are given to the components identical to the components of the multifunctional apparatus 1 of the first embodiment, and the descriptions thereof are not repeated.

As in the ink reservoir 220 (FIG. 4A) of the second embodiment, part at the upper portion of the side surface (rear surface) of ink reservoir 320 of the recording head 300, corresponding to the position of the elastic members 121*b* and 121*d*, is dented to the inner side (frontward) The elastic members 121*b* and 121*d* are provided farther from the rear end surface of the ink reservoir 320 than the elastic members 121*a* and 121*c*. Thereby, the ink supply openings 122*b* and 122*d* are provided farther from the rear end surface 223 of the ink reservoir 220 than the ink supply openings 122*a* and 122*c*. Each of the supply openings 122*a* to 122*d* is provided on the surface at a different level from the surface(s) where the adjacent ink supply opening(s) are provided. As in the second embodiment, the ink supply openings 122*a* and 122*c* are provided on the rear end surface of the ink reservoir 320, and the ink supply openings 122*b* and 122*d* are provided the same distance away from the rear end surface of the ink reservoir 320.

In addition, as in the ink reservoir 120 of the first embodiment (FIG. 3B), part at the rear portion of the upper surface of the ink reservoir 320, corresponding to the positions of the elastic members 121*b* and 121*d*, projects upward so that the elastic members 121*b* and 121*d* are disposed at a higher position than the elastic members 121*a* and 121*c*. Accordingly, the ink supply openings 122*b* and 122*d* are disposed higher than the ink supply openings 122*a* and 122*c* in such a way that, when viewed from behind, the ink supply openings 122*a* to 122*d* as a whole are arranged to form a zigzag. As in the first embodiment, the ink supply openings 122*a* and 122*c* are arranged at the same level, and the ink supply openings 122*b* and 122*d* are arranged at the same level.

On the other hand, the supply nozzles 131*a* to 131*d* of the ink supply mechanism 830 are arranged to face the corresponding ink supply openings 122*a* to 122*d* in such a way that, when the carriage 11 is at the predetermined ink refill position, the ink supply mechanisms 330 is moved toward the ink reservoir 320 (forward) and that the supply nozzles 131*a* to 131*d* are inserted to the corresponding ink supply openings 122*a* to 122*d*.

As noted above, the multifunctional apparatus 1 of the third embodiment is constituted such that each of the sub-tanks 320*a* to 320*d* of the recording head 300 is refilled with one of four colors of ink from the main tanks 21*a* to 21*d*. The ink supply openings 122*a* to 122*d* that allow the supply of ink are arranged to form a zigzag (FIG. 5A). Also, each of the ink supply openings 122*a* to 122*d* is provided on the surface at a different level than the surface(s) where the adjacent ink supply opening(s) are provided. The darkest color (black) ink and the second darkest color (magenta) ink among the four colors of ink are respectively supplied to the ink supply openings 122*c* and 122*a* which are provided on the rear end surface of the ink reservoir 320.

Consequently, according to the multifunctional apparatus 1 of the third embodiment, the same effects as stated above for the first and second embodiments can be achieved.

Fourth Embodiment

Figure 6:
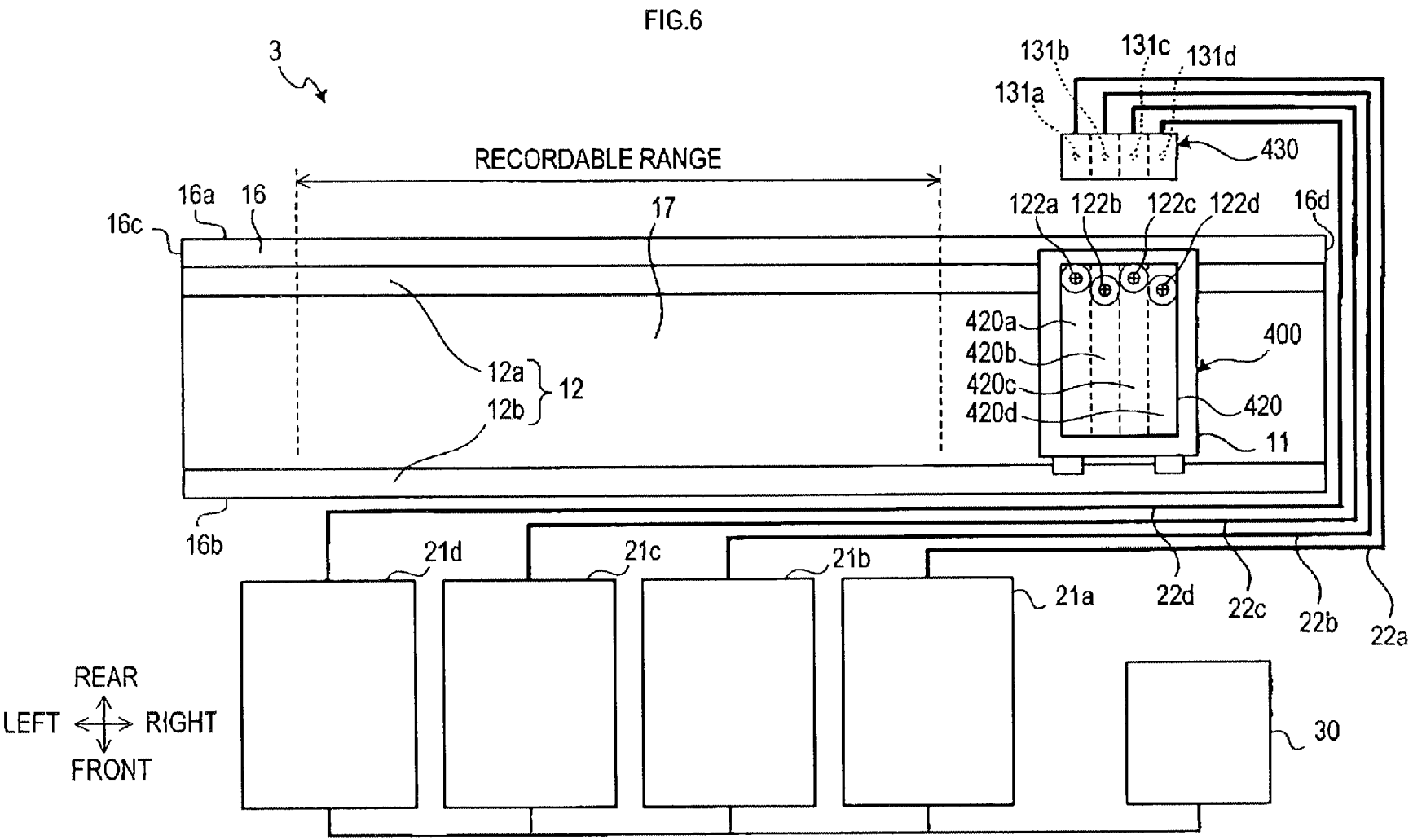
FIG. 6 is a schematic top view showing an internal structure of a printer provided in a multifunctional apparatus according to a fourth embodiment.

The multifunctional apparatus 1 according to the fourth embodiment is explained hereinafter. The appearance (FIG. 1) of the multifunctional apparatus 1 according to the fourth embodiment is identical to the appearance of the multifunctional apparatus 1 according to the first embodiment. However, the internal structure (FIG. 2) of the printer 3 is partly different. Particularly, as shown in FIG. 6, an ink supply mechanism 430 is provided to face the upper surface of the recording head 400 (FIG. 6 shows an ink supply mechanism 430 displaced rearward from the actual position of the ink supply mechanism 430, for the sake of easy understanding of the structure of an ink reservoir 420), and not to face the rear surface thereof. The ink supply mechanism 430 is constituted such that the ink supply mechanism 430 can reciprocate in a vertical direction (toward/away from the upper surface of a recording head 400) by the driving force of the ink supply mechanism driving motor 140 (see FIG. 7B). The ink supply openings 122*a* to 122*d* are arranged on the upper surface of the ink reservoir 420. The same reference numbers are given to the components identical to the components of the multifunctional apparatus 1 of the first embodiment, and the descriptions thereof are not repeated.

As shown in FIG. 6, the printer 3 includes a recording head 400, the carriage 11, the guide mechanism 12, the carriage moving mechanism (not shown), the sheet delivery mechanism (not shown), etc. The guide mechanism 12 holds the carriage 11 with the recording head 400 mounted thereon in such a manner that the carriage 11 can move in a horizontal direction or a main scanning direction. The carriage moving mechanism moves the carriage 11 in the horizontal direction. The sheet delivery mechanism delivers a sheet fed from the feeding device 2. The printer 3 is also provided with the frame 16 of a rectangular parallelepiped. The frame 16 is long in the horizontal direction and short in a vertical direction.

The four main tanks (ink cartridges) 21*a* to 21*d* which respectively store a different color of ink are attached to the cartridge attachment portion provided on the front side of the frame 16. The four colors of ink is to be supplied to later-explained sub-tanks 420*a* to 420*d*. Particularly, yellow color ink is stored in the main tank 21*a*, cyan in the main tank 21*b*, magenta in the main tank 21*c*, and black in the main tank 21*d*.

The main tanks 21*a* to 21*d* are connected via the four flexible ink tubes 22*a* to 22*d* too an ink supply mechanism 430 which is disposed in the vicinity of the right end of the frame 16. In particular, one end of the ink tube 22*a* is connected to the main tank 21*a*, and the other end of the ink tube 22*a* is connected to the supply mechanism 430, so that the ink tube 22*a* serves as an ink supply passage for supplying yellow color ink in the main tank 21*a* to the ink supply mechanism 430. Likewise, one end of the ink tube 22*b* is connected to the main tank 21*b*, and the other end of the ink tube 22*b* is connected to the supply mechanism 130, so that the ink tube 22*b* serves as an ink supply passage for supplying cyan color ink in the main tank 21*b* to the ink supply mechanism 430. Likewise, one end of the ink tube 22*c* is connected to the main tank 21*c*, and the other end of the ink tube 22*c* is connected to the supply mechanism 430, so that the ink tube 22*c* serves as an ink supply passage for supplying magenta color ink in the main tank 21*c* to the ink supply mechanism 430. Likewise, one end of the ink tube 22*d* is connected to the main tank 21*d*, and the other end of the ink tube 22*d* is connected to the supply mechanism 430, so that the ink tube 22*d* serves as an ink supply passage for supplying black color ink in the main tank 21*d* to the ink supply mechanism 430.

The ink supply mechanism 430 is provided to face the upper surface (the surface on which ink supply openings 122*a* to 122*d* are provided) of the recording head 400 (particularly, the ink reservoir 420), when the carriage 11 is located at the predetermined ink refill position (shown in FIG. 6) outside (in particular, at the right side of) the range (recordable range) where image recording by the recording head 400 can be performed. The ink supply mechanism 430 is constituted such that the ink supply mechanism 430 can reciprocate in the vertical direction (toward/away from the upper surface of the recording head 400) by the driving force of the ink supply mechanism driving motor 140 (see FIG. 7B). The ink supply mechanism 430 includes the four tubular supply nozzles 131*a* to 131*d* for supplying ink stored in the main tanks 21*a* to 21*d* to the recording head 400 (the ink reservoir 420, in particular). More precisely, the supply nozzle 131*a* is constituted to eject, from the tip, yellow color ink supplied from the main tank 21*a* via the ink tube 22*a*. Likewise, the supply nozzle 131*b* is constituted to eject, from the tip, cyan color ink supplied from the main tank 21*b* via the ink tube 22*b*, the supply nozzle 131*c* is constituted to eject, from the tip, magenta color ink supplied from the main tank 21*c* via the ink tube 22*c*, and the supply nozzle 131*d* is constituted to eject, from the tip, black color ink supplied from the main tank 21*d* via the ink tube 22*d*. The ink stored in the main tanks 21*a* to 21*d* is supplied to the ink supply mechanism 430 by the pressure from the pump 30.

Figure 7A:
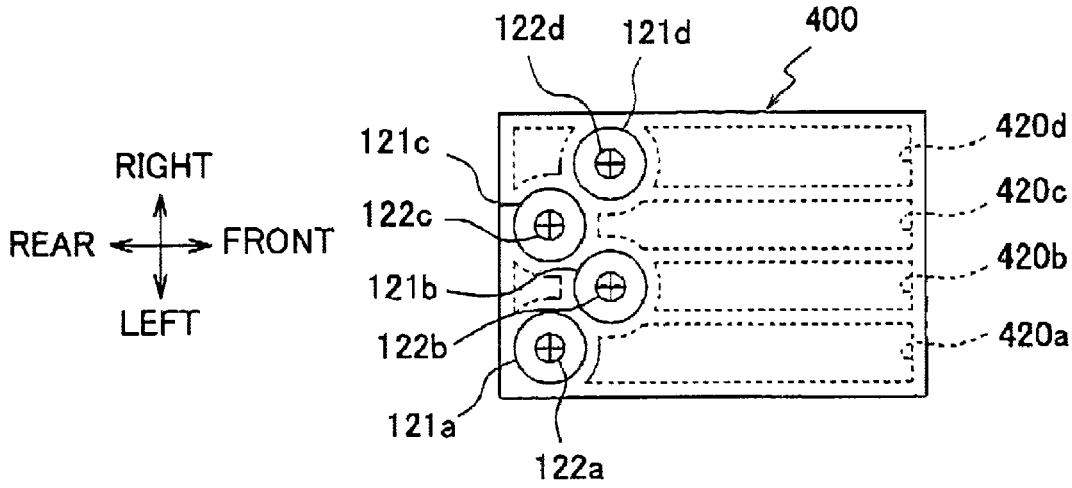
FIGS. 7A and 7B are explanatory view of a recording head and an ink supply mechanism according to the fourth embodiment.
Figure 7B:
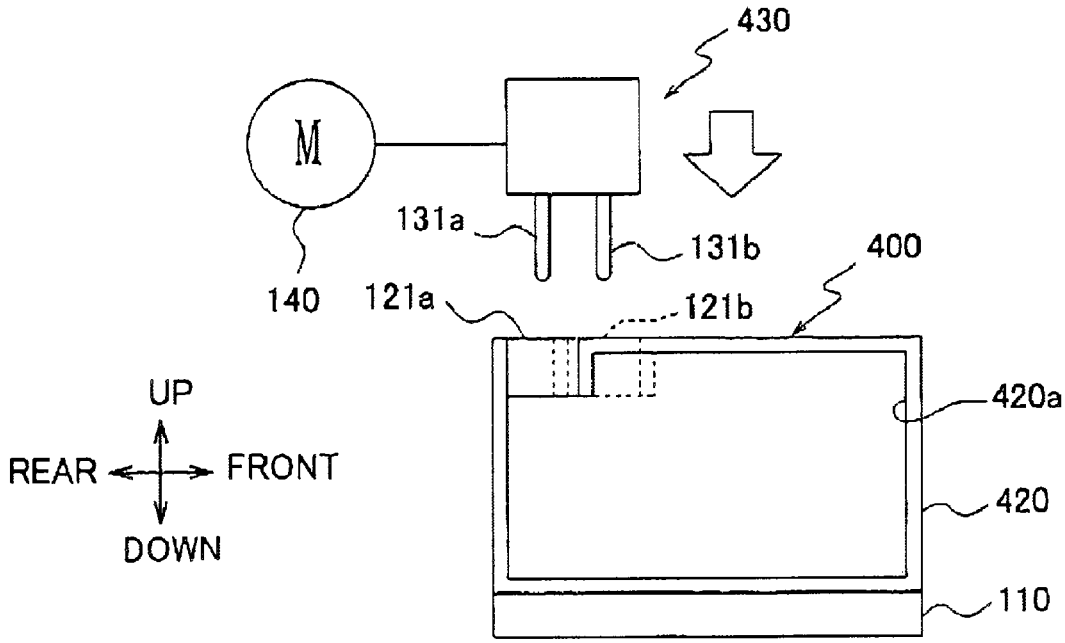

As shown in FIG. 7B, the recording head 400 includes the ink ejector 110 that ejects ink onto a sheet, and the ink reservoir 420 that is provided on the top of the ink ejector 110 and stores ink ejected from the ink ejector 110.

The ink reservoir 420 includes the internal sub-tanks 420*a* to 420*d*, each of which stores one of the four colors of ink. The recording head 400 is constituted such that the different colors of ink stored in the sub-tanks 420*a* to 420*d* is supplied to the corresponding ejection nozzle groups of the ink ejector 110. Image recording onto a sheet is performed by selectively ejecting ink in the sub-tanks 420*a* to 420*d* from the ejection nozzle groups of the ink ejector 110, based on the image data representing an image to be recorded.

On the upper surface of the ink reservoir 420, the ink supply openings 122*a* to 122*d* are provided through which ink to be supplied (for a refill) from the main tanks 21*a* to 21*d* is received. Particularly, a round opening is formed at the rear part of the upper wall (the wall of the upper surface) of the respective sub-tanks 420*a* to 420*d*, and the elastic members 121*a* to 121*d* are applied to close the corresponding openings. A cross-shaped cut which communicates the inside and outside of the ink reservoir 420 is provided at the center part of the respective elastic members 121*a* to 121*d*. These cuts form the ink supply openings 122*a* to 122*d*, to which the supply nozzles 131*a* to 131*d* of the ink supply mechanism 130 are inserted. This constitution renders possible to seal the ink supply openings 122*a* to 122*d* due to resilience of the elastic members 121*a* to 121*d*, when the supply nozzles 131*a* to 131*d* are not inserted to the ink supply openings 122*a* to 122*d*.

On the upper surface of the ink reservoir 420, the elastic members 121*b* and 121*d* are disposed closer to the center (forward) as compared to the elastic members 121*a* and 121*c*. Accordingly, the ink supply openings 122*h* and 122*d* are disposed closer to the center than the ink supply openings 122*a* and 122*c* in such a way that, when viewed from the top, the ink supply openings 122*a* to 122*d* as a whole are arranged to form a zigzag (FIG. 7A). In the present embodiment, the ink supply openings 122*a* and 122*c* are arranged at the same position in the back and forth direction, and the ink supply openings 122*b* and 122*d* are arranged at the same position in the back and forth direction.

The supply nozzles 131*a* to 131*d* of the ink supply mechanism 430 are arranged to form a zigzag, and face the corresponding ink supply openings 122*a* to 122*d* provided on the upper surface of the ink reservoir 420, so that the supply nozzles 131*a* to 131*d* are inserted to the corresponding ink supply openings 122*a* to 122*d* by moving the ink supply mechanism 430 toward the ink reservoir 420 (downward) when the carriage 11 is at the predetermined ink refill position (the position shown in FIG. 6). More particularly, the supply nozzle 131*a* is inserted to the ink supply opening 122*a* as the ink supply mechanism 430 approaches the ink reservoir 420, and supplies yellow color ink to the sub-tank 420*a* from the main tank 21*a* via the ink tube 22*a*. The supply nozzle 131*b* is inserted to the ink supply opening 122*b* as the ink supply mechanism 430 approaches the ink reservoir 420, and supplies cyan color ink to the sub-tank 420*b* from the main tank 21*b* via the ink tube 22*b*. The supply nozzle 131*c* is inserted to the ink supply opening 122*c* as the ink supply mechanism 430 approaches the ink reservoir 420, and supplies magenta color ink to the sub-tank 420*c* from the main tank 21*c* via the ink tube 22*c*. The supply nozzle 131*d* is inserted to the ink supply opening 122*d* as the ink supply mechanism 430 approaches the ink reservoir 420, and supplies black color ink to the sub-tank 420*d* from the main tank-21*d* via the ink tube 22*b*.

As noted above, the multifunctional apparatus 1 of the fourth embodiment is constituted such that each of the sub-tanks 420*a* to 420*d* of the recording head 400 is refilled with one of four colors of ink from the main tanks 21*a* to 21*d*. The ink supply openings 122*a* to 122*d* are arranged to form a zigzag (FIG. 7A).

Therefore, as stated in the above first embodiment, according to the multifunctional apparatus 1 of the fourth embodiment, the ink reservoir 420 (recording head 400) can be miniaturized, and thus the multifunctional apparatus 1 can be reduced in size.

Also, according to the multifunctional apparatus 1 of the fourth embodiment, the darker color of ink is supplied to the ink supply opening which is farther from the recordable range when the carriage 11 is located at the ink refill position. Consequently, even if a different color or colors of ink are undesirably introduced to the supply openings 122*a* to 122*d*, it is possible to minimize the influence.

That is, if ink dribbles down from the supply nozzles 131*a* to 131*d* of the ink supply mechanism 430, it is possible that the ink supply openings 122*a* to 122*d* may be contaminated by a different color or colors of ink. Chances are high that the ink supply opening among the ink supply openings 122*a* to 122*d* which is farther from the recordable range when the carriage 11 is located at the predetermined ink refill position may be contaminated by a different color or colors of ink. This is because the carriage 11 travels longer below the ink supply mechanism 430 when moving between the ink refill position and the recordable range. For the same reasons, chances are low that the ink from the supply nozzles 131*a* to 131*d* disposed farther away from the recordable range may enter the ink supply openings 122*a* to 122*d* for different colors of ink. Therefore, the darker color of ink, which is less influenced even if a different color or colors of ink are introduced and which have a significant influence if introduced to the ink supply openings for different colors of ink, is supplied to the ink supply opening which is farther from the recordable range when the carriage 11 is located at the predetermined ink refill position. Particularly, the darkest color (black) ink is supplied to the ink supply opening 122*d* which is the farthest from the recordable range. Likewise, the second darkest color (magenta) ink is supplied to the ink supply opening 122*c* which is the second farthest from the recordable range, the third darkest color (cyan) ink is supplied to the ink supply opening 122*b* which is the third farthest from the recordable range, and the fourth darkest color (yellow) ink is supplied to the ink supply opening 122*a* which is the fourth farthest from the recordable range. Accordingly, even in the case of mixing of different colors of ink, it is possible to reduce the influence.

Fifth Embodiment

Figure 8A:
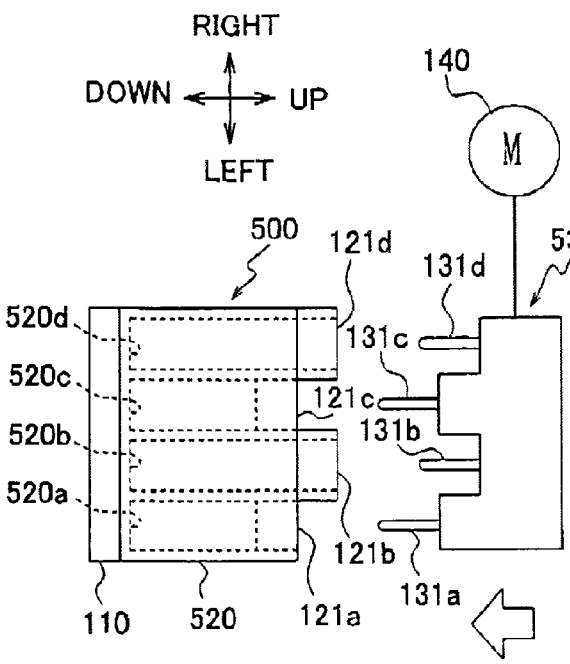
FIGS. 8A to 8C are explanatory views of a recording head and an ink supply mechanism according to a fifth embodiment.
Figure 8B:
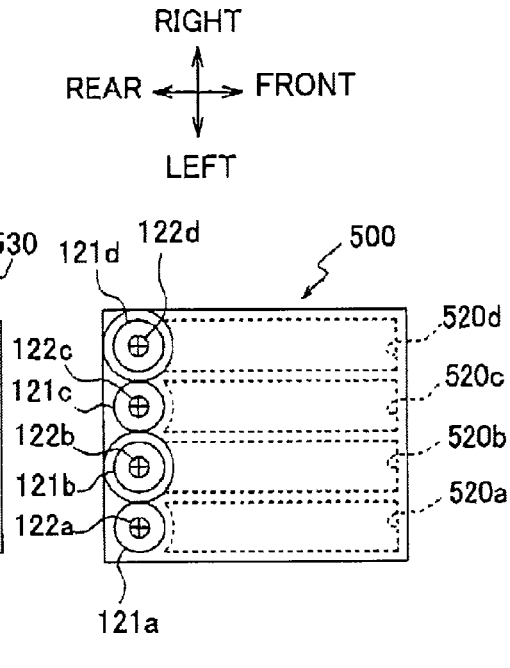
Figure 8C:
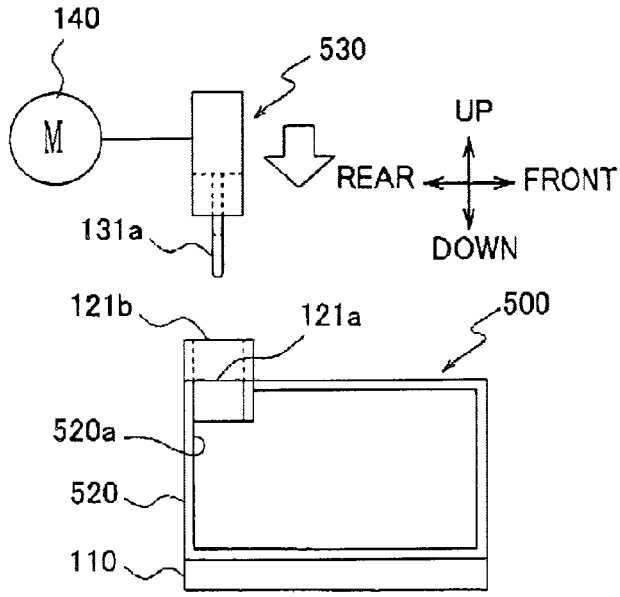

The multifunctional apparatus 1 according to the fifth embodiment is explained hereinafter. The appearance (FIG. 1) of the multifunctional apparatus 1 according to the fifth embodiment is identical to the appearance of the multifunctional apparatus 1 according to the fourth embodiment. However, the internal structure (FIG. 6) of the printer 3 is partly different. Particularly, as shown in FIGS. 8A and 8B, in an ink reservoir 500 of a recording head 600 provided in the multifunctional apparatus 1 of the fifth embodiment, the ink supply openings 122*a* to 122*d* are linearly arranged and not to form a zigzag when viewed from the top (FIG. 8B). Moreover, each of the ink supply openings 122*a* to 122*d* is provided on a surface at a different level than the surface(s) where the adjacent ink supply opening(s) are provided (FIG. 8A). Accordingly, in an ink supply mechanism 530 provided in the multifunctional apparatus 1 of the fifth embodiment, the supply nozzles 131*a* to 131*d* are arranged linearly and not to form a zigzag when viewed from the front. Moreover, positions of the front ends of the supply nozzles 131*a* to 131*d* are different from the position(s) of the front end(s) of the adjacent supply nozzle(s) (FIG. 8A). That is, the multifunctional apparatus 1 of the fifth embodiment is different from the multifunctional apparatus 1 of the fourth embodiment in the arrangement of the ink supply openings 122*a* to 122*d* and the supply nozzles 131*a* to 131*d*. In addition, in the multifunctional apparatus 1 of the fifth embodiment, the color of ink stored in the main tanks 21*a* to 21*d* is different as compared to the multifunctional apparatus 1 of the fourth embodiment. Particularly, similar to the first embodiment, a magenta color of ink is stored in the main tank 21*a*, a yellow color of ink in the main tank 21*b*, a black color of ink in the main tank 21*c*, and a cyan color of ink in the main tank 21*d*. The same reference numbers are given to the components identical to the components of the multifunctional apparatus 1 of the fourth embodiment, and the descriptions thereof are not repeated.

Part on the upper surface of the ink reservoir 520 of the recording head 500, corresponding to the positions of the elastic members 121*b* and 121*d*, projects upward so that the elastic members 121*b* and 121*d* are disposed at a higher position than the elastic members 1211*a* and 121*c*. Accordingly, the ink supply openings 122*b* and 122*d* are disposed higher than the ink supply openings 122*a* and 122*c*. In the present embodiment, the ink supply openings 122*a* and 122*c* are arranged at the same level, and the ink supply openings 122*b* and 122*d* are arranged at the same level.

The supply nozzles 131*a* to 131*d* of the ink supply mechanism 530 are arranged to face the corresponding ink supply openings 122*a* to 122*d* provided on the upper surface of the ink reservoir 520 in such a way that, when the carriage 11 is at the predetermined ink refill position, the ink supply mechanisms 530 is moved toward the ink reservoir 520 (downward) and that the supply nozzles 131*a* to 131*d* are inserted to the corresponding ink supply openings 122*a* to 122*d*.

As noted above, the multifunctional apparatus 1 of the fifth embodiment is constituted such that each of the sub-tanks 520*a* to 520*d* of the recording head 500 is refilled with one of four colors of ink from the main tanks 21*a* to 21*d*. Each of the ink supply openings 122*a* to 122*d* that allow the supply of ink is provided on the surface at a different level than the surface(s) where the adjacent ink supply opening(s) are provided (FIG. 8A).

Therefore, according to the multifunctional apparatus 1 of the fifth embodiment, as stated in the second embodiment, unintended entering of a different color or colors of ink to the ink supply opening, 122*a* to 122*d* can be avoided.

In the multifunctional apparatus 1 of the fifth embodiment, since each of the ink supply openings 122*a* to 122*d* is provided on the surface at a different level than the surface(s) where the adjacent ink supply opening(s) are provided on the upper surfaces of the corresponding sub-tanks 520*a* to 520*d*, levels at which each of the ink supply openings 122*a* to 122*d* is disposed are not uniform. The darkest color (black) ink and the second darkest color (magenta) ink among the four colors of ink are respectively supplied to the ink supply openings 122*c* and 122*a* which are provided at the lowest position.

Consequently, according to the multifunctional apparatus 1 of the fifth embodiment, as stated in the first embodiment, even if a different color or colors of ink are undesirably introduced to the supply openings 122*a* to 122*d*, it is possible to minimize the influence.

Sixth Embodiment

Figure 9A:
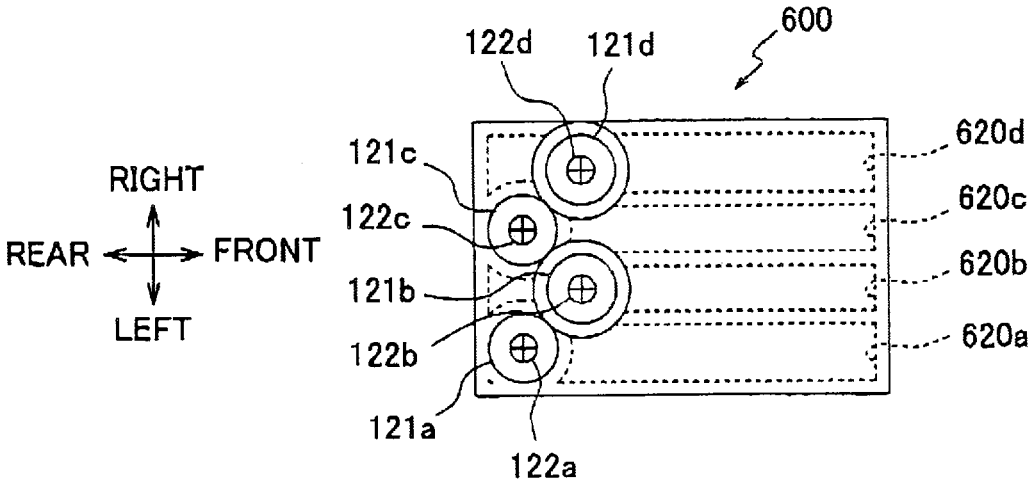
FIGS. 9A and 9B are explanatory views of a recording head and an ink supply mechanism according to a sixth embodiment.
Figure 9B:
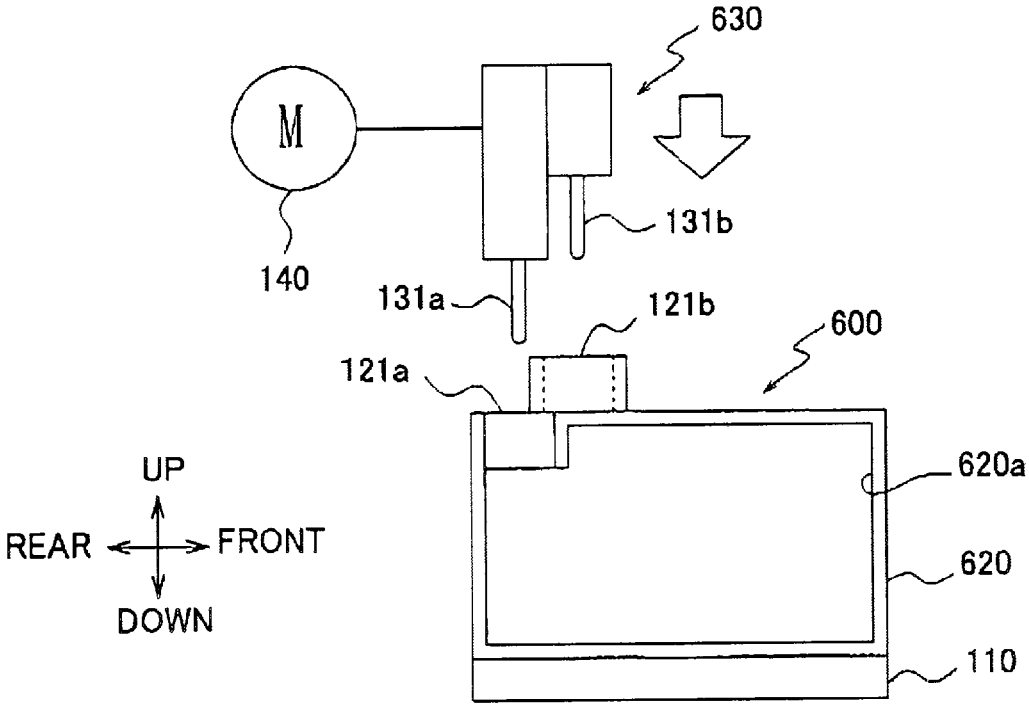

The multifunctional apparatus 1 according to the sixth embodiment is explained hereinafter. The appearance (FIG. 1) of the multifunctional apparatus 1 according to the sixth embodiment is identical to the appearance of the multifunctional apparatus 1 according to the fourth embodiment. However, the internal structure (FIG. 6) of the printer 3 is partly different. Particularly, as shown in FIGS. 9A and 9B, in an ink reservoir 600 of a recording bead 600 provided in the multifunctional apparatus 1 of the sixth embodiment, the ink supply openings 122*a* to 122*d* are arranged to form a zigzag when viewed from the top (FIG. 9A) as in the fourth embodiment. However, each of the ink supply openings 122*a* to 122*d* is provided, as in the fifth embodiment, on a surface at a different level than the surface(s) where the adjacent ink supply opening(s) are provided. Accordingly, in an ink supply mechanism 630 provided in the multifunctional apparatus 1 of the sixth embodiment, the supply nozzles 131*a* to 131*d* are arranged to form a zigzag when viewed from the front as in the fourth embodiment. However, positions of the front ends of the supply nozzles 131*a* to 131*d* are different from the position(s) of the front end(s) of the adjacent supply nozzle(s) as in the fifth embodiment. That is, the multifunctional apparatus 1 of the sixth embodiment is different from the multifunctional apparatus 1 of the fourth embodiment in the arrangement of the ink supply openings 122*a* to 122*d* and the supply nozzles 131*a* to 131*d*. In addition, in the multifunctional apparatus 1 of the sixth embodiment, the color of ink stored in each of the main tanks 21*a* to 21*d* is different as compared to the multifunctional apparatus 1 of the fourth embodiment. Particularly, similar to the first embodiment, a magenta color of ink is stored in the main tank 21*a*, a yellow color of ink in the main tank 21*b*, a black color of ink in the main tank 21*c*, and a cyan color of ink in the main tank 21*d*. The same reference numbers are given to the components identical to the components of the multifunctional apparatus 1 of the fourth embodiment, and the descriptions thereof are not repeated.

On the upper surface of the ink reservoir 620, the elastic members 121*b* and 121*d* are disposed closer to the center (forward) as compared to the elastic members 121*a* and 121*c*, as in the ink reservoir 620 of the fourth embodiment. Accordingly, the ink supply openings 122*b* and 122*d* are disposed closer to the center than the ink supply openings 122*a* and 122*c* in such a way that, when viewed from the top, the ink supply openings 122*a* to 122*d* as a whole are arranged to form a zigzag (FIG. 9A). In the present embodiment, the ink supply openings 122*a* and 122*c* are arranged at the same position in the back and forth direction, and the ink supply openings 122*b* and 122*d* are arranged and the same position in the back and forth direction.

In addition, as in the ink reservoir 620 of the fifth embodiment (FIG. 8B), part at the rear portion of the upper surface of the ink reservoir 620, corresponding to the positions of the elastic members 121*b* and 121*d*, projects upward so that the elastic members 121*b* and 121*d* are disposed at a higher position than the elastic members 121*a* and 121*c*. Accordingly, the ink supply openings 122*b* and 122*d* are disposed higher than the ink supply openings 122*a* and 122*c*. As in the fifth embodiment, the ink supply openings 122*a* and 122*c* are arranged at the same level, and the ink supply openings 122*b* and 122*d* are arranged at the same level.

On the other hand, the supply nozzles 131*a* to 131*d* of the ink supply mechanism 630 are arranged to face the corresponding ink supply openings 122*a* to 122*d* in such a way that, when the carriage 11 is at the predetermined ink refill position, the ink supply mechanisms 630 is moved toward the ink reservoir 620 (downward) and that the supply nozzles 131*a* to 131*d* can be inserted to the corresponding ink supply openings 122*a* to 122*d*.

As noted above, the multifunctional apparatus 1 of the sixth embodiment is constituted such that each of the sub-tanks 620*a* to 620*d* of the recording head 600 is refilled with one of four colors of ink from the main tanks 21*a* to 21*d*. The ink supply openings 122*a* to 122*d* that allow the supply of ink are arranged to form a zigzag (FIG. 9A). Also, each of the ink supply openings 122*a* to 122*d* is provided on the surface at a different level than the surface(s) where the adjacent ink supply opening(s) are provided. The darkest color (black) ink and the second darkest color (magenta) ink among the four colors of ink are respectively supplied to the ink supply openings 122*c* and 122*a* which are disposed at the lowest position. Also, in each pair of the ink supply openings 122*a* and 122*c*, and the ink supply openings 122*b* and 122*d*, which are disposed at the same respective levels, the darker color of ink is supplied to the ink supply opening which is farther from the recordable range when the carriage 11 is located at the predetermined ink refill position. Particularly, the darkest color (black) of ink is supplied to the ink supply opening 122*c* which is farther from the recordable range between the two ink supply openings 122*a* and 122*c* located at the lower position. The lightest color (yellow) of ink is supplied to the ink supply opening 122*b* which is closer to the recordable range between the two ink supply openings 122*b* and 122*b* located at the higher position.

Consequently, according to the multifunctional apparatus 1 of the sixth embodiment, the same effects as stated for the fourth and fifth embodiments can be achieved.

Embodiments of the present invention are described in the above. However, the present invention can be practiced in various manners without departing from the technical scope of the invention.

For example, in the above embodiments, the present invention is applied to a so-called serial ink-jet recording apparatus in which the recording head 100 reciprocates in a direction orthogonal to a sheet delivery direction. However, the present invention can be applied to a so-called line head ink-jet recording apparatus of which recording head includes ejection nozzles arranged across the full width of a sheet and fixed at a predetermined position.

What is claimed is:

1. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, and wherein at least four ink supply openings are provided, the at least four ink supply openings are arranged to form a zigzag shape, and each of the ink supply openings is provided on a side surface of the corresponding sub-tanks at a normal use state of the ink-jet recording apparatus, and a darkest color of ink among the plurality of colors of ink is supplied to the ink supply opening of all the ink supply openings which is arranged at a lowest position.

2. The ink-jet recording apparatus according to claim 1, wherein each of ink supply openings is provided on a surface at a different level than the surface(s) where the adjacent ink supply opening(s) are provided.

3. The ink-jet recording apparatus according to claim 2, further comprising a carriage that mounts the recording head thereon and is capable of reciprocating in a direction orthogonal to a delivery direction of a recording medium, wherein the ink supply member supplies the ink in the main tanks to the ink supply openings provided in the corresponding sub-tanks, when the carriage is located at a predetermined ink refill position outside a recordable range which is a range where image recording by the recording head can be performed on the recording medium, each of the ink supply openings is provided on an upper surface of the corresponding sub-tank at a normal use state of the ink-jet recording apparatus, and a darkest color of ink among the plurality of colors of ink is supplied to the ink supply opening of all the ink supply openings which is farthest from the recordable range when the carriage is located at the ink refill position.

4. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, and wherein at least four ink supply openings are provided, the at least four ink supply openings are arranged to form a zigzag shape, and each of the ink supply openings is provided on an upper surface of the corresponding sub-tanks at a normal use state of the ink-jet recording apparatus, and a darkest color of ink among the plurality of colors of ink is supplied to the ink supply opening of all the ink supply openings which is provided on a lowest surface.

5. The ink-jet recording apparatus according to claim 4, wherein each of the ink supply openings is provided on a side surface of the corresponding sub-tanks at a normal use state of the ink-jet recording apparatus, and a darkest color of ink among the plurality of colors of ink is supplied to the ink supply opening of all the ink supply openings which is arranged at a lowest position.

6. The ink-jet recording apparatus according to claim 4, further comprising a carriage that mounts the recording head thereon and is capable of reciprocating in a direction orthogonal to a delivery direction of a recording medium, wherein the ink supply member supplies the ink in the main tanks to the ink supply openings provided in the corresponding sub-tanks, when the carriage is located at a predetermined ink refill position outside a recordable range which is a range where image recording by the recording head can be performed on the recording medium, and a darkest color of ink among the plurality of colors of ink is supplied to the ink supply opening of all the ink supply openings which is farthest from the recordable range when the carriage is located at the ink refill position.

7. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, and wherein at least four ink supply openings are provided, the at least four ink supply openings are arranged to form a zigzag shape, and each of the ink supply openings is provided on a side surface of the corresponding sub-tanks at a normal use state of the ink-jet recording apparatus, and a darkest color of ink among the plurality of colors of ink is supplied to the ink supply opening of all the ink supply openings which is provided on a most outer surface.

8. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, wherein at least four ink supply openings are provided, each of the ink supply openings is provided on a surface at a different level than at least one of the surfaces where at least one of the adjacent ink supply openings are provided such that the surfaces are arranged to form a zigzag shape, and each of the ink supply openings is provided on a side surface of the corresponding sub-tanks at a normal use state of the ink-jet recording apparatus, and a darkest color of ink among the plurality of colors of ink is supplied to the ink supply opening of all the ink supply openings which is arranged at a lowest position.

9. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, wherein at least four ink supply openings are provided, each of the ink supply openings is provided on a surface at a different level than at least one of the surfaces where at least one of the adjacent ink supply openings are provided such that the surfaces are arranged to form a zigzag shape, and each of the ink supply openings is provided on an upper surface of the corresponding sub-tanks at a normal use state of the ink-jet recording apparatus, and a darkest color of ink among the plurality of colors of ink is supplied to the ink supply opening of all the ink supply openings which is provided on a lowest surface.

10. The ink-jet recording apparatus according to claim 9, further comprising a carriage that mounts the recording head thereon and is capable of reciprocating in a direction orthogonal to a delivery direction of a recording medium, wherein the ink supply member supplies the ink in the main tanks to the ink supply openings provided in the corresponding sub-tanks, when the carriage is located at a predetermined ink refill position outside a recordable range which is a range where image recording by the recording head can be performed on the recording medium, and a darkest color of ink among the plurality of colors of ink is supplied to the ink supply opening of all the ink supply openings which is farthest from the recordable range when the carriage is located at the ink refill position.

11. An ink-jet recording apparatus comprising:

a recording head that has a plurality of sub-tanks, each of the sub-tanks storing a different color of ink, the recording head recording an image onto a recording medium by selectively ejecting different colors of ink in the sub-tanks from ejection nozzles;

main tanks that store ink to refill the corresponding sub-tanks; and an ink supply member that supplies the ink in the main tanks to the corresponding sub-tanks, each of the sub-tanks being provided with an ink supply opening for receiving the ink to be supplied, the ink supply member supplying the ink in the main tanks to the ink supply openings provided in the sub-tanks, wherein at least four ink supply openings are provided, each of the ink supply openings is provided on a surface at a different level than at least one of the surfaces where at least one of the adjacent ink supply openings are provided such that the surfaces are arranged to form a zigzag shape, and each of the ink supply openings is provided on a side surface of the corresponding sub-tanks at a normal use state of the ink-jet recording apparatus, and a darkest color of ink among the plurality of colors of ink is supplied to the ink supply opening of all the ink supply openings which is provided on a most outer surface.

* * * * *